US006640071B2

(12) United States Patent
Okada

(10) Patent No.: US 6,640,071 B2
(45) Date of Patent: Oct. 28, 2003

(54) CLEANER-LESS TYPE IMAGE FORMING MACHINE

(75) Inventor: Naohiro Okada, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 93 days.

(21) Appl. No.: 10/036,800

(22) Filed: Nov. 8, 2001

(65) Prior Publication Data

US 2002/0057926 A1 May 16, 2002

(30) Foreign Application Priority Data

Nov. 16, 2000 (JP) ..... 2000-349702

(51) Int. Cl.[7] ..... G03G 15/24
(52) U.S. Cl. ..... 399/150
(58) Field of Search ..... 399/149, 150, 399/31, 34, 71, 175, 353, 354

(56) References Cited

U.S. PATENT DOCUMENTS 6,118,952 A * 9/2000 Furuya ..... 399/50
6,215,967 B1 * 4/2001 Takeda et al. ..... 399/43

FOREIGN PATENT DOCUMENTS

JP 09244352 A * 9/1997 ..... G03G/15/02
JP 11-237825 8/1999
JP 11237825 A * 8/1999 ..... G03G/21/10
JP 11-258920 9/1999
JP 2002156881 A * 5/2002 ..... G03G/21/14

* cited by examiner

*Primary Examiner*—Robert Beatty
(74) *Attorney, Agent, or Firm*—Hogan & Hartson, LLP

(57) ABSTRACT

A cleaner-less type image forming machine for removing the toner accumulated in the memory removing brush, and improving the quality of the image forming onto the recording medium is provided. The image forming machine includes a photoconductive drum, a charge brush for charging the photoconductive drum, LED print head for forming an electrostatic latent image on the surface of the charged photoconductive drum, a developing roller for developing the electrostatic latent image on the surface of the photoconductive drum, a transferring roller for transferring a toner image on the photoconductive drum to a paper, a memory removing brush for removing the toner image remaining on the photoconductive drum, and a current detector for detecting current flowing through the memory removing member, wherein a cleaning sequence of the toner adhered to the memory removing member is carried out. The length of the time for carrying out the cleaning sequence is changed according to the current flowing through the memory removing member, in other words, according to the amount of toner accumulated in the memory removing member.

12 Claims, 6 Drawing Sheets

CLEANER-LESS TYPE IMAGE FORMING MACHINE

CROSS REFERENCES TO RELATED APPLICATIONS

This application claims priority of Japanese Patent Application No.2000-349702 filed in JPO together on Nov. 16, 2000, the entire disclosures of which are incorporated herein by reference.

BACKGROUND OF THE INVENTION

1. Field of the Invention

The present invention relates to an image forming machine of cleaner-less type for improving the quality of an image forming to a recording medium by removing effectively a toner accumulated in a memory removing brush.

2. Description of the Related Art

According to the image forming machine of electrophotographic type, a cleaning processing for removing untransferred toner remaining on the surface of a photoconductive drum is necessary. For the cleaning processing, the image forming machine comprises a cleaner including a blade for scraping off the untransferred toner from the surface of the photoconductive drum.

When providing such cleaner in the image forming machine, there is a problem in that a maintenance for members such as a blade becomes necessary. Therefore, an image forming machine of cleaner-less type for reusing the untransferred toner remaining on the surface of the photoconductive drum after collecting with the developer, is developed. The image forming machine of cleaner-less type has an advantage in that the structure is simplified since a cleaner is not provided.

In the image forming machine of cleaner-less type, to scatter the untransferred toner remaining on the surface of the photoconductive drum, a memory removing member (such as a brush) is provided. When the toner adheres to the memory removing brush and accumulates, the memory removing effect decreases. Therefore, during the operation sequence of the image forming machine, a cleaning sequence for the memory removing member is inserted.

When the toner is accumulated in the memory removing member, the resistance value of the memory removing member increases, and the current flowing into the memory removing member decreases. A special attention was paid to the electric characteristic of such memory removing member, and an image forming machine which detects the current flowing into the memory removing member, judges that an excess toner has accumulated in the memory removing member when the detected current becomes less than the predetermined value, and then carries out a cleaning sequence to the memory removing member, is proposed.

The cleaning sequence for the memory removing member proposed conventionally sets the timing to start the cleaning when the absolute value of the detected value of the current flowing into the memory removing member becomes lower than the predetermined value, and the cleaning time was fixed. Therefore, when the toner of amount beyond expectation is accumulated in the memory removing member, there were cases in which the toner cannot be removed fully during a fixed period of time. As a result, there were problems in that the quality of the image forming to the recording medium decreases due to the generation of white areas in the image by the photoconductive body failing to be charged.

SUMMARY OF THE INVENTION

The present invention was made in consideration to such situation, and it is thus the object of the present invention to provide an image forming machine of cleaner-less type for removing the toner accumulating in the memory removing brush effectively and improving the quality of the image forming to the recording medium.

According to the first aspect of the present invention, the image forming machine comprises a photoconductive body, a charging member for charging the photoconductive body, a means for forming an electrostatic latent image on the surface of the charged photoconductive body, a developing unit for developing the electrostatic latent image on the surface of the photoconductive body, a transferring unit for transferring a toner image on the photoconductive body to a recording medium, a memory removing member for removing the toner image remaining on the photoconductive body, and a detecting means for detecting the current flowing through the memory removing member, wherein a cleaning sequence of the toner adhered to the memory removing member is carried out, and the length of the time for carrying out the cleaning sequence is changed according to the current flowing through the memory removing member.

Moreover, according to the second aspect of the present invention, the image forming machine comprises a photoconductive body, a charging member for charging the photoconductive body, a mean for forming an electrostatic latent image on the surface of the charged photoconductive body, a developing member for developing the electrostatic latent image on the surface of the photoconductive body, a transferring member for transferring a toner image on the photoconductive body to a recording medium, a memory removing member for removing the toner image remaining on the photoconductive body, and a detecting means for detecting the current flowing through the memory removing member, wherein a cleaning sequence of the toner adhered to the memory removing member is carried out, and the frequency for carrying out the cleaning sequence is changed according to the current flowing through the memory removing member.

Furthermore, according to the third aspect of the present invention according to claim 2 of the present invention, the image forming machine is characterized in that the cleaning sequence is carried out each time the image is formed on the recording medium of a predetermined quantity, and the frequency to carry out the cleaning sequence is changed by changing the quantity of recording medium on which the image is formed.

According to the first aspect, the length of the time to carry out the cleaning sequence is changed according to the current flowing through the memory removing member. Therefore, when the absolute value of the detected value of the current flowing through the memory removing member is small due to the increased amount of the toner accumulated in the memory removing member, by lengthening the time to carry out the cleaning sequence, the toner accumulated in the memory removing member can be removed effectively. As a result, the quality of the image forming to the recording medium can be improved.

According to the second aspect, the frequency for carrying out the cleaning sequence is changed according to the current flowing through the memory removing member. Therefore, when the absolute value of the detected value of the current flowing through the memory removing member is small due to the increased amount of toner accumulated in the memory removing member, by increasing the frequency to carry out the cleaning sequence, in other words, by increasing the number of times for carrying out cleaning sequence within a fixed period of time, the toner accumulated in the memory removing member can be removed effectively. As a result, the quality of image forming to the recording medium can be improved.

According to the third aspect, the frequency for carrying out the cleaning sequence is changed by changing the quantity of the recording medium of which the image is formed. Therefore, since the cleaning sequence is carried out after the image is formed on the recording medium within a limited quantity, and since the generation of time wherein the image cannot be formed on the recording medium by unnecessary cleaning sequence is prevented, the image forming to the recording medium can be carried out efficiently.

DETAILED DESCRIPTION OF THE PREFERRED EMBODIMENTS

The embodiments of the present invention will be described in reference to the accompanying drawings.

Figure 1:
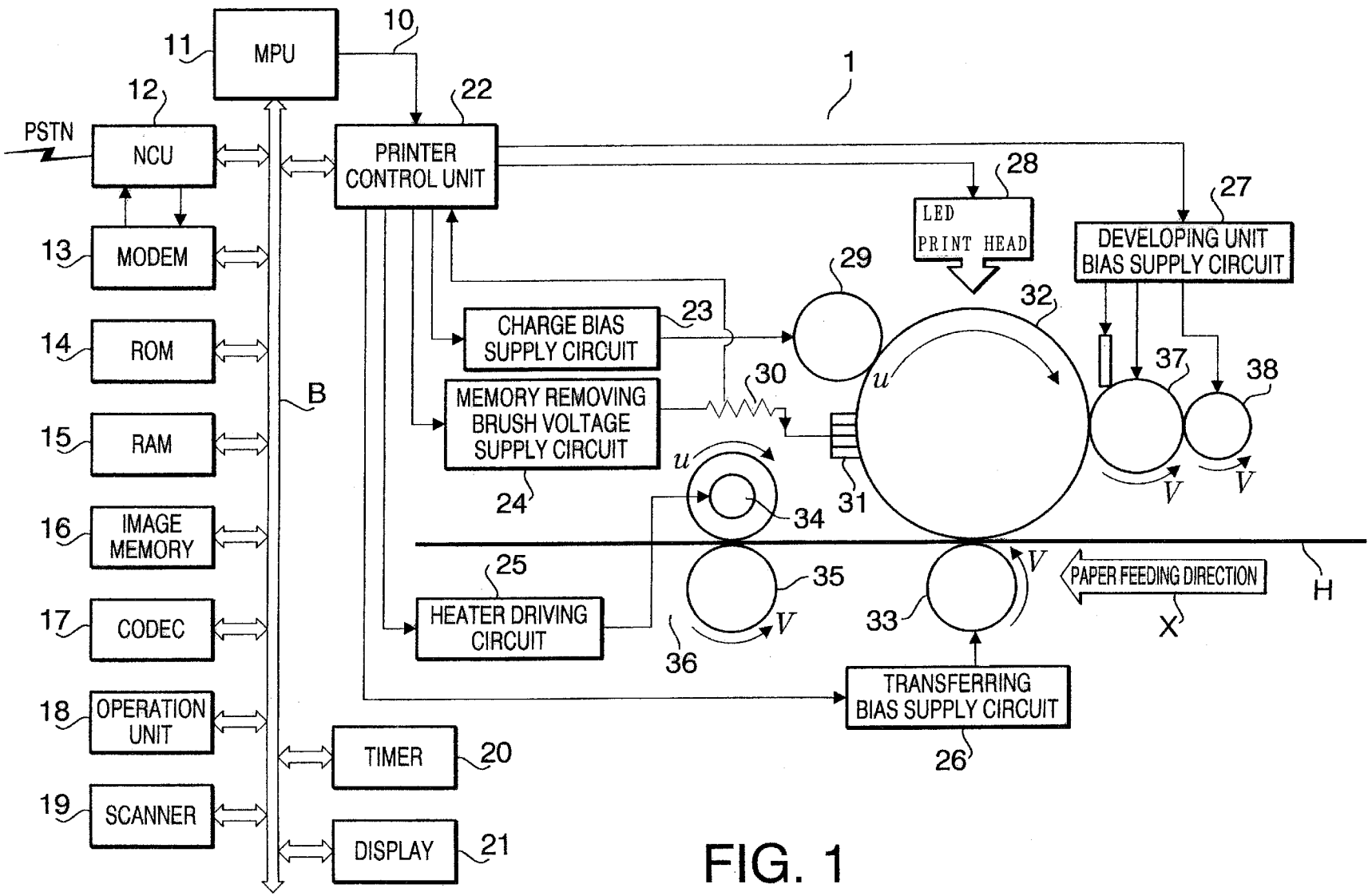
FIG. 1 is a block diagram showing an image forming machine according to an embodiment of the present invention.

FIG. 1 is a block diagram showing the schematic structure of the image forming machine of which the present invention is to be applied. An image forming machine 1 is formed as a facsimile machine with copying function. Referring to FIG. 1, a control device 10 of the image forming machine comprises a control unit 11 for processing various signals and data. For example, the control unit 11 is formed of MPU (Micro Processor Unit).

A network control unit (NCU) 12, a modem 13, ROM 14, RAM 15, an image memory 16, a coder and decoder (CODEC) 17, an operation unit 18, a scanner 19, a timer 20, a display 21, and a printer control unit 22 are connected to the control unit 11 via a bus B.

The network control unit 12 is connected to a public switched telephone network (PSTN), and transmits a dial pulse corresponding to the dial number of the other end, and detects the calling tone. The modem 13 modulates the data to be transmitted between a communication terminal device such as a facsimile machine of the other end, and demodulates the received data. Moreover, the modem 13 is connected to the network control unit 12.

ROM 14 stores data and programs necessary for various operations of the image forming machine. Moreover, RAM 15 stores management data for delayed transmission or the memory receiving. The image memory 16 stores the image data of the read image and the received image data.

CODEC 17 encodes by a designated encoding method for transmitting the image data of the image read by the scanner 19 and the once received image data, and decodes the received image data. The operation unit 18 comprised of such as a keyboard or a mouse, the user orders various operations and the stopping of the image forming machine with the operation unit 18. In the operation unit 18, various keys, for example, copy keys, a power saving key, a numeric pad, a start key, a stop key, which are necessary for the operation of the machine are provided. Furthermore, a copy/communication key is provided for selecting the complex machine of either function of copy mode and facsimile communication mode.

The timer 20 counts the present time, and the receiving time of the image data is saved in the communication management record. On the display 21 adopting a cathode ray tube (CRT) or a liquid crystal display (LCD), various messages necessary for the operation of the image forming machine are displayed.

A charge bias supply circuit 23, a memory removing brush voltage supply circuit 24, a heater driving circuit 25, a transfer bias supply circuit 26, a developing bias supply circuit 27, and LED print head 28 are connected to the printer control unit 22. The operation of the printer control unit 22 will be described later on.

Next, the image forming processing of the image forming machine 1 will be described. The printer control unit 22 transmits a signal to the charge bias supply circuit 23, applies charged bias to the charge brush 29, and charges evenly the surface of the photoconductive drum 32 rotating in the arrow U direction. In other words, the charge brush 29 acts as a charging member to the photoconductive drum 32 (photoconductive body). Next, LED print head 28 is operated by the signal from the printer control unit 22, and an electrostatic latent image is formed by the irradiating light from LED print head 28. As in the manner stated above, LED print head 28 serves as an exposing unit forming the electrostatic latent image on the surface of the photoconductive body.

The printer control unit 22 transmits a signal to the developing bias supply circuit 27, applies developing bias to the developing roller 37 rotating in the arrow V direction, supplies toner to the electrostatic latent image from the developing roller 34, and the image is visualized as the toner image. From the toner container of the developing unit not shown in the drawings, the toner is adhered to the developing roller 37 in a thin layer of designated thickness via a supply roller 38 rotating in the arrow V direction. The toner adhered to the developing roller 37 is transferred toward the electrostatic latent image formed in the photoconductive drum 32, and the toner image is formed.

The paper of which the image is to be printed is transported from the arrow X direction to the position of the transferring roller 33 through the transporting path H. The printer control unit 22 transmits a signal to the transferring bias supply circuit 26, supplies transferring bias to the transferring roller 33 rotating in the arrow V direction, and the toner image formed in the photoconductive drum 32 is transferred to the paper at a position in which the transferring roller 33 contacts with the paper.

The printer control unit 22 transmits a signal to the heater driving circuit 25, and by operating the heater 34 rotating in the arrow U direction and the press roller –35 rotating in the arrow V direction, the toner image is adhered to the paper of which the toner image is transferred by the fuser unit 36 comprised of the heater 34 and the press roller 35, and the printed paper is discharged.

The signal from the printer control unit 22 is transmitted to the memory removing brush voltage supply circuit 24, and a voltage is supplied to the memory removing brush 31. After the toner image is transferred to the paper at a position of the transferring roller 33, the toner image remaining in the photoconductive drum 32 is scattered by the memory removing brush 31, the adhering force is decreased and scattered on the surface of the photoconductive drum 32.

Next, the toner remaining in the photoconductive drum 32 is collected by the developing roller 37. Then, the toner supplied anew via the supply roller 38 from the toner container, and the collected toner is mixed and adhered to the developing roller 37.

Reference code 30 is a current detector of the memory removing brush 31, and the detected value of the current detector is input into the printer control unit 22. Based on this information of the current value, MPU 11 judges whether or not the current of the memory removing brush 31 is lower than the designated value.

In other words, when an excess toner is accumulated in the memory removing brush 31, since the toner is a particle of insulator, the resistance value of the memory removing brush 31 increases and the current value detected by the current detector decreases. When MPU 11 judges that the cleaning sequence of the memory removing brush 31 is necessary from the current value, a signal to order a cleaning sequence is transmitted to the printer control unit 22.

The printer control unit 22 outputs a signal to a charge bias supply circuit 23, a memory removing brush voltage supply circuit 24, and a transferring bias supply circuit 26. Then, the charge brush 29, the memory removing brush 31, and the transferring roller 33 are not supplied with a voltage and are put off.

Moreover, a signal to supply a designated voltage, for example, (+) 300V, to the developing roller 37 is output to the developer bias supply circuit 27 from the printer control unit 22. In this regard, the negative charged toner is transferred from the memory removing brush 31 to the photoconductive drum 32. Subsequently, the toner is transferred from the photoconductive drum 32 to the developing roller 37, and the toner accumulated in the memory removing brush 31 is collected by the developer.

According to the present invention, it is judged whether or not the amount of the toner accumulated in the memory removing brush 31 is excessive in reference to the current value flowing into the memory removing brush 31. Then, by changing the length of the time for carrying out the cleaning sequence or the frequency for carrying out the cleaning sequence according to the amount of toner accumulated in the memory removing brush 31, the toner can be collected from the memory removing brush 31 reliably.

Figure 2:
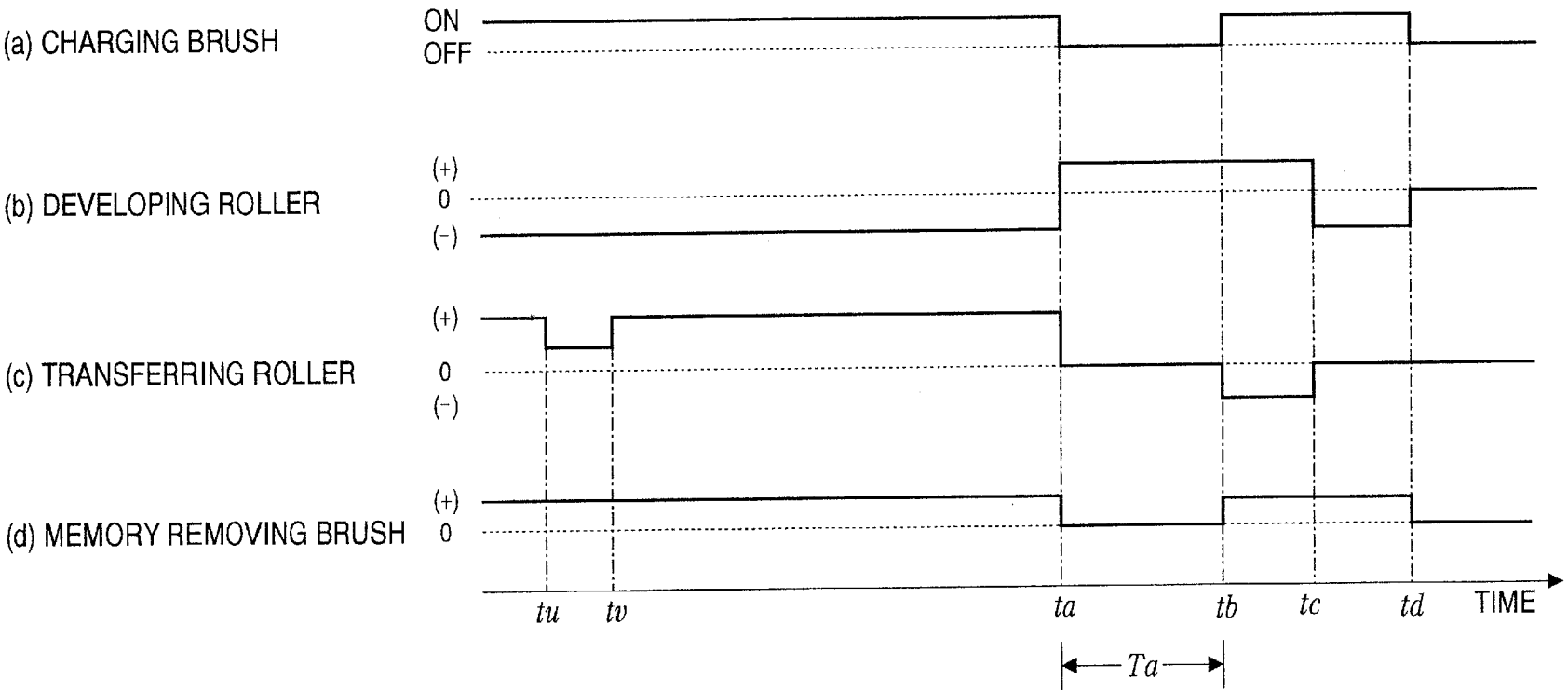
FIG. 2 is a timing chart for describing the operation of the image forming machine according to the embodiment of the present invention.
Figure 3:
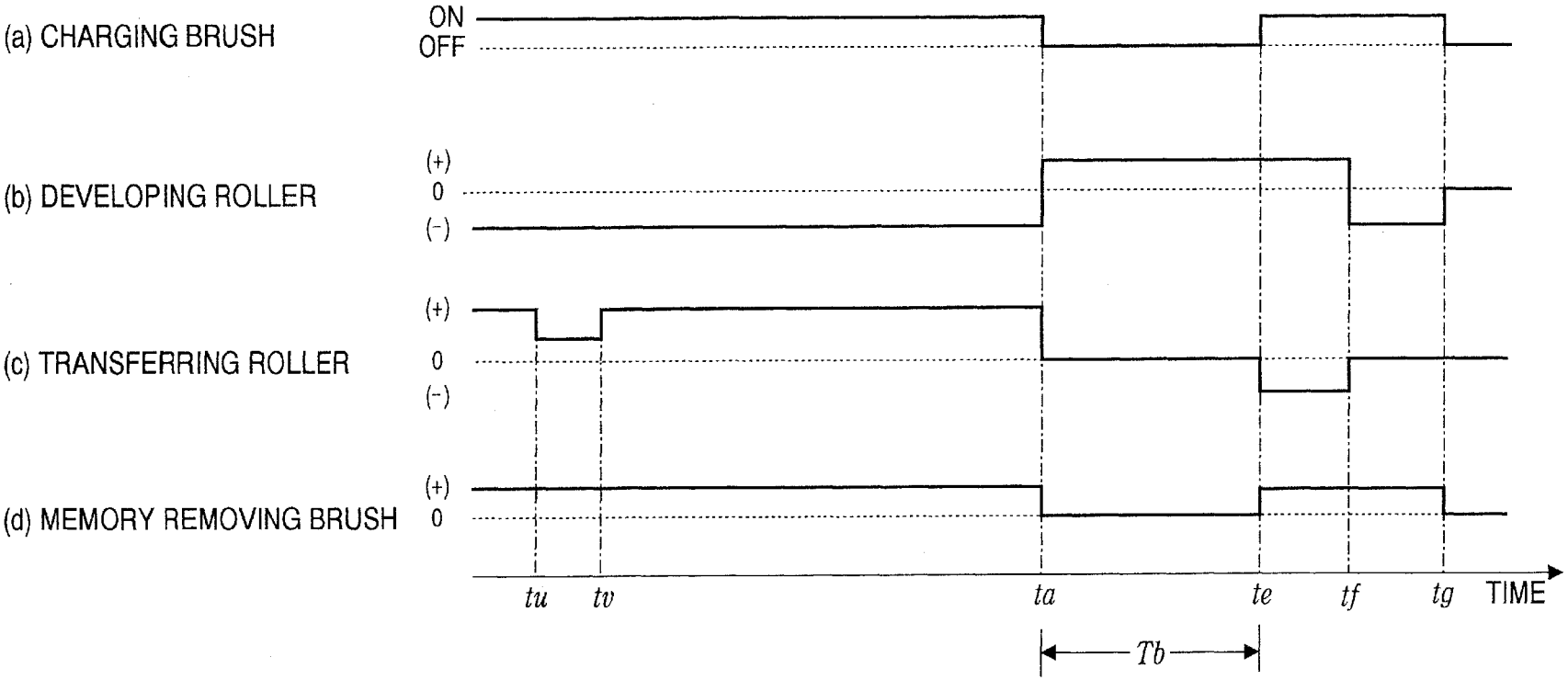
FIG. 3 is a timing chart for describing the operation of the image forming machine according to the embodiment of the present invention.

FIG. 2 and FIG. 3 are timing charts showing an example of the cleaning sequence according to the present invention. In FIG. 2 and FIG. 3, (a) indicates the electric potential of the charge brush 29, and the high level shows the state in which the supply voltage is on, and the low level shows the state in which the supply voltage is off. (b) indicates the electric potential of the developing roller 34, and for example, a voltage of (+) 300V is supplied in the high level, and a voltage of (−) 300V is supplied in the low level.

(c) indicates the electric potential of the transferring roller 33, and for example, at high level, a voltage of (+)3.7 KV is supplied, and in the low level, a voltage of (−)900V is supplied. (d) indicates the electric potential of the memory removing brush 31, and for example, at high level, a voltage of (+)300V is supplied, and in the low level, a voltage of 0V is supplied.

In the example shown in FIG. 2, at time Ta that is from time ta to time tb, the cleaning sequence is carried out to the memory removing brush. When the cleaning sequence is started, the charge brush, the transferring roller, and the memory removing brush are not supplied with a voltage and are put off. Moreover, a predetermined (+) voltage is supplied to the developing roller.

In this regard, the toner charged in negative as in the manner stated above is transferred to the photoconductive drum from the memory removing brush. When the cleaning sequence completes, the charge brush is put on accordingly at time tb, a voltage of (+) 300V is supplied to the memory removing brush, and the remaining toner and the redeveloping toner are scattered on the photoconductive drum. Then, the charge brush is put off at time td, and the electric potential of the memory removing brush is made to be 0.

Even after time tb when the cleaning sequence is completed, a voltage of (+) 300V is supplied to the developing roller during time tb and time tc, and the remaining toner scattered on the photoconductive drum is collected by the developer. At time tc, a voltage of (−) 300V is supplied to the developing roller, and the redeveloping toner is transferred to the photoconductive drum. Then, the electric potential of the developing roller is made to be 0 at time td. The transferring roller reaches the electric potential of (−) during time tb and time tc, and carries out a designated process.

In the transferring roller, papers, which are the recording medium, are transported repetitively with an interval, and when the paper passes the transferring roller, a voltage of (+) 3.7 KV is applied. Moreover, in the area where the transferred article is not present between a paper and a paper, the supplying voltage of the transferring roller is controlled by the transferring bias supply circuit as to decrease the supply voltage of the transferring roller.

Referring to the voltage characteristic of the transferring roller in FIG. 2, a voltage of (+) is decreasing from time tu to time tv. During this period of time, a transferred article does not exist between a paper and a paper. Therefore, by counting the number of terms of when the voltage is lowered as in time tu through time tv, the quantity of papers with image formed can be confirmed. The cleaning sequence can be inserted by each time an image is formed to the paper of predetermined quantity.

In FIG. 3, time Tb of the time between time ta and time te is made to be the length of time for carrying out the cleaning sequence. The length of the time Tb for carrying out the cleaning sequence is to be set longer than the length of the time Ta for carrying out the cleaning sequence in FIG. 2. In other words, comparing to the current of the memory removing brush in the example shown in FIG. 2, it corresponds to the case in which the current of the memory removing brush is decreasing as in the example shown in FIG. 2.

The operation of the charge brush, the developing roller, and the memory removing brush from time te to time tg, corresponds to each operation of the charge brush, the developing roller, and the memory removing brush from time tb to time td in FIG. 2. Moreover, as mentioned above, the voltage characteristic of the transferring roller supplied during time tu and time tv, corresponds to the voltage supplied between the papers transported to the transferring roller.

Figure 4:
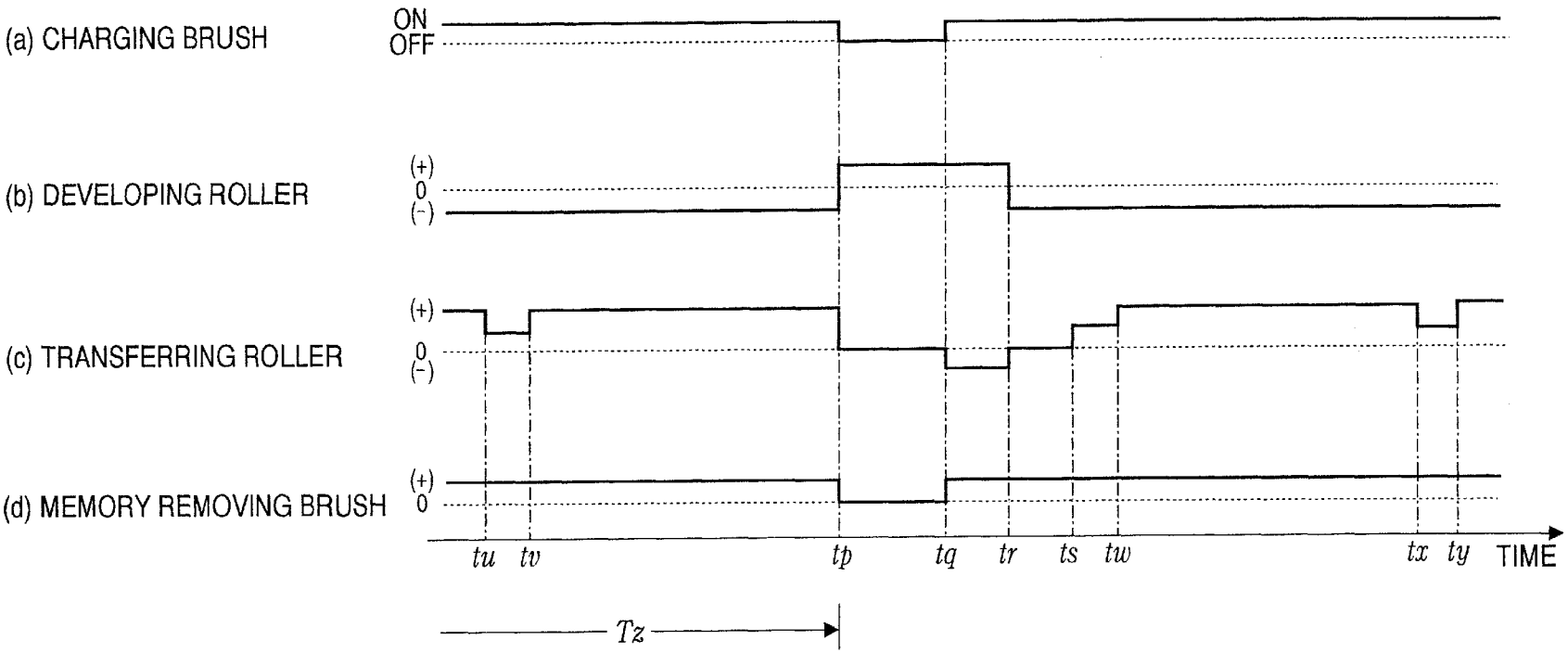
FIG. 4 is a timing chart for describing the operation of the image forming machine according to another embodiment of the present invention.

FIG. 4 is a timing chart showing an example of another cleaning sequence according to the present invention. In the example shown in FIG. 4, the cleaning sequence is inserted in the time between time tp and time tq. In this example, the timing for inserting the cleaning sequence is set by the quantity of the paper of which the image is formed.

Referring to FIG. 4, the time between the time tu and time tv when the (+) voltage supplied to the transferring roller decreases, and the time between time tx and time ty, corresponds to the border of the paper and paper transported by the transferring roller. Time tp of the timing to start the cleaning sequence is set according to the quantity of the paper of which the image is formed during a certain period of time of Tz.

In other words, in the example shown in FIG. 4, it is set of when to carry out the cleaning sequence according to the quantity of the paper with image formed based on the detected current of the memory removing brush. Such setting of the cleaning sequence corresponds to the number of times to carry out the cleaning sequence within a certain period of time, for example, Tz, in other words, the changing of the frequency for carrying out the cleaning sequence.

Referring to FIG. 4, the charge brush is put on at time tq, when the cleaning sequence is completed, a voltage of (+) 300V is supplied to the memory removing brush, and the remaining toner and the redeveloping toner are scattered on the photoconductive drum. A voltage of (+) 300V is supplied to the developing roller from time tq, when the cleaning sequence has completed, to time tr, and the remaining toner scattered on the surface of the uncharged photoconductive drum is collected to the developer. At time tr, a voltage of (−) 300V is supplied to the developing roller, and the redeveloping toner is transferred to the photoconductive drum. The transferring roller changes electric potential in time so that the transferring roller reaches an electric potential of negative value (−) during time tq and tr, and reaches at electric potential of 0 at time from tr to ts, turns over to positive value (+) electric potential during time ts to tw, and becomes to be the prescribed electric potential of positive value (+) at time tw. By changing the electric potential like these, the surface of the transferring roller is cleaned.

Figure 5:
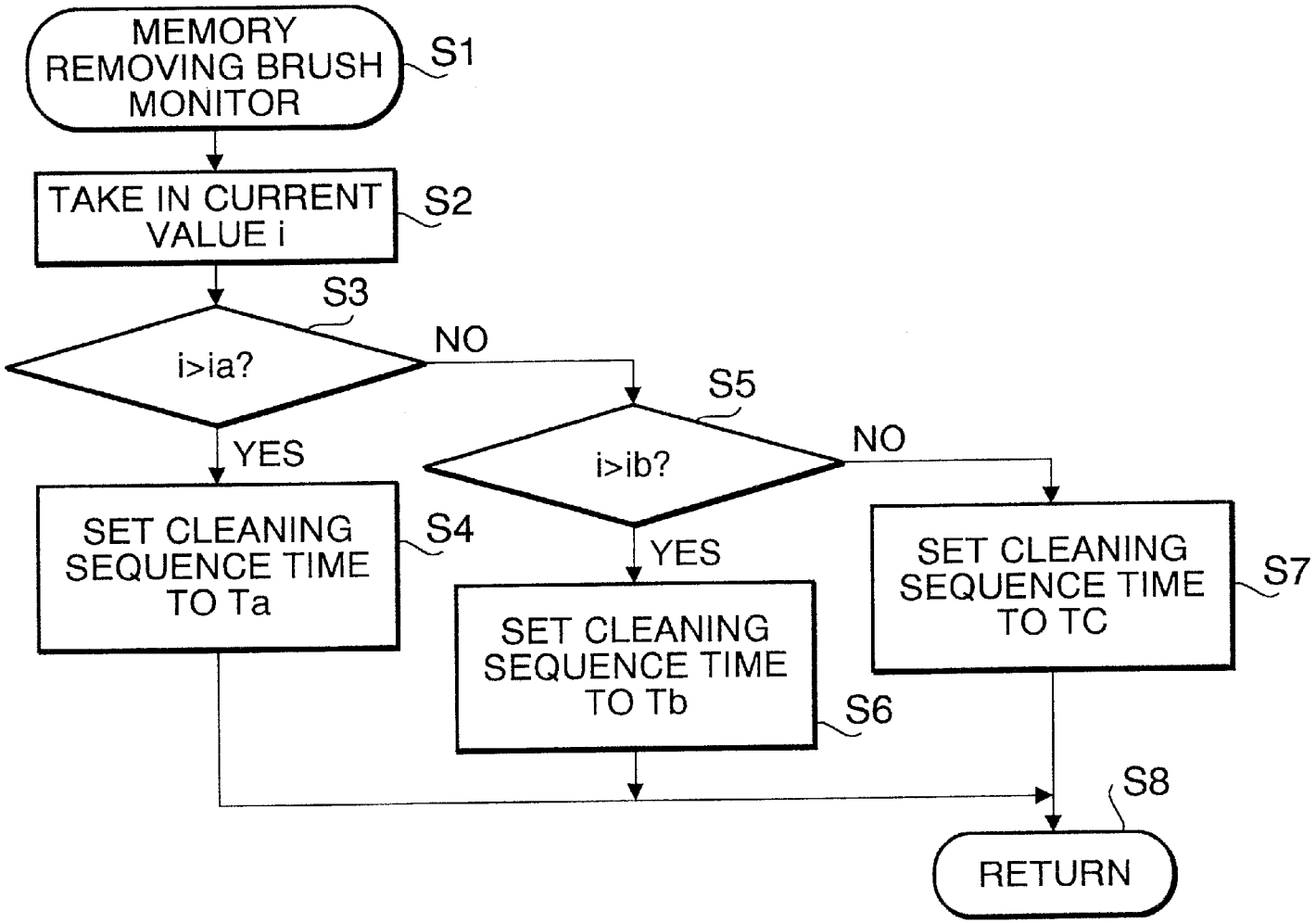
FIG. 5 is a flow chart showing the processing procedure of the present invention.

FIG. 5 is a flow chart showing the processing procedure of the current detection of the memory removing brush monitor according to the present invention, in other words, the memory removing brush. Next, this flow chart will be described.

(1) In step S1, the processing program is started, and in step S2, the current value i of the memory removing brush is taken in. Next, the current value i and the set value ia are compared, and it is judged whether or not i>ia or not. When the judged result is YES (hereafter abbreviated as Y), it proceeds to the process of step S4, and the length of the time for carrying out the cleaning sequence is set to be Ta as shown in FIG. 2.

(2) When the judged result in step S3 is NO (hereafter abbreviated as N), in the process of step S5, the current value i and the set value ib are compared, and it is judged whether i>ib or not. When the judged result is Y, it proceeds to the process in step S6, and the length of the time to carry out the cleaning sequence is set to be Tb as shown in FIG. 3.

(3) When the judged result in step S5 is N, the current value i is lower than ic. Therefore, the length of the time for carrying out the cleaning sequence in the process of step S7, is set to be Tc. At last, it returns in the process of step S8. The relationship among set values of the current and the length of the time to carry out the cleaning sequence, are to be ia>ib>ic, Ta<Tb<Tc. In other words, since the amount of toner accumulated in the memory removing brush increases as the current value becomes smaller, the time for carrying out the cleaning sequence is set to be long.

As in the manner stated above, in the example shown in FIG. 5, the current value of the memory removing brush is compared accordingly with the set value set beforehand, and the length of the time to carry out the cleaning sequence is set according to the size of the current value. Therefore, since the length of the time for carrying out an appropriate cleaning sequence is set according to the amount of toner accumulated in the memory removing brush, the toner accumulated in the memory removing brush can be collected effectively.

Figure 6:
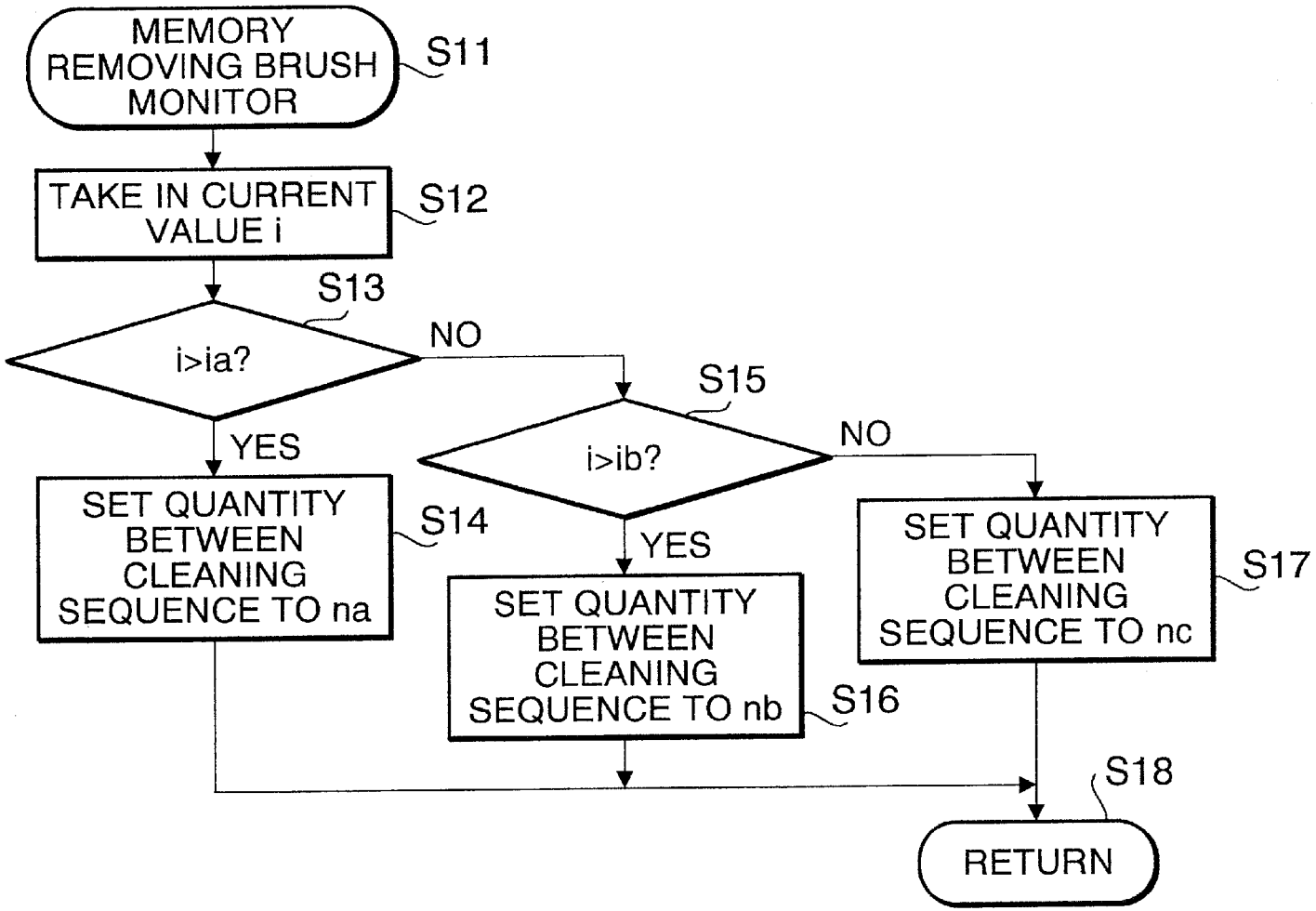
FIG. 6 is another flow chart showing the processing procedure of the present invention.

FIG. 6 is a flow chart showing another processing procedure of the memory removing brush monitor according to the present invention. Next this flow chart will be described.

(1) In step S11, the processing program is started, and in step S12, the current value i of the memory removing brush is taken in. Next, the current value i and the set value ia are compared, and it is judged whether i>ia or not. When the judged result is Y, it proceeds to the process of step S14, and the start time of the cleaning sequence is set when the quantity of papers of which the image is formed reaches na.

(2) When the judged result in step S13 is N, in the process of step S15, the current value i and the set value ib are compared, and it is judged whether i>ib or not. When the judged result is Y, it proceeds to the process in step S16, and the start time of the cleaning sequence is set when the quantity of papers of which the image is formed reaches nb.

(3) When the judged result in step S15 is N, the current value i is lower than ic. Therefore, the start time of the cleaning sequence is set when the quantity of the paper of which the image is formed reaches nc in the process of step S17. At last, it returns in the process of step S18. The set value of the quantity of paper, of which the image is formed when starting the current and the cleaning sequence, are to be ia>ib>ic, na>nb>nc. In other words, since the amount of the toner accumulated in the memory removing brush is to be large as the current value is small, the quantity of the paper of which the image is formed before the beginning of the cleaning sequence during a certain period of time is set to be small.

As in the manner stated above, in the example shown in FIG. 6, by comparing the current value of the memory removing brush to the values set beforehand in turn, according to the size of the current value, the quantity of papers with image formed is set before the cleaning sequence starts during a certain period of time. As a result, according to the amount of the toner accumulated in the memory removing brush, the number of times for carrying out the cleaning sequence during a certain period of time, in other words, the frequency of the cleaning sequence is set. Therefore, the toner accumulated in the memory removing brush can be collected by the developer effectively, and the quality of the image forming to the paper that is the recording medium can be made preferable.

What is claimed is:

1. An image forming machine, comprising:

a photoconductive body:

a transferring unit for transferring a toner image on the photoconductive body to a recording medium;

a memory removing member for decreasing an adhering force by diffusing the toner image remaining on the photoconductive body;

a detecting circuit of current flowing through the memory removing member; and a control unit;

wherein a cleaning sequence of the toner adhered to the memory removing member is controlled and the frequency for carrying out the cleaning according to the current flowing through the memory removing member is changed, wherein the control unit carries out the cleaning sequence when the number of the recording medium of which the image is formed reaches a designated number, and by changing the designated number, the frequency of the cleaning sequence can also be changed.

2. An image forming machine according to claim 1 wherein a predetermined voltage is applied to the memory removing member and the current at the time when the voltage is applied to the memory removing member is detected by the detecting circuit.

3. An image forming machine according to claim 2 wherein the memory removing member is a brush.

4. An image forming machine according to claim 1, further comprising:

a charging member for charging the photoconductive body.

5. An image forming machine according to claim 1, further comprising:

an exposing unit for forming an electrostatic latent image on the surface of the charged photoconductive body.

6. An image forming machine according to claim 1, further comprising:

a developing unit for developing the electrostatic latent image on the surface of the photoconductive body.

7. An image forming machine, comprising:

a photoconductive body;

a transferring unit for transferring a toner image on the photoconductive body to a recording medium;

a memory removing member for decreasing an adhering force by diffusing the toner image remaining on the photoconductive body;

a detecting circuit of current flowing through the memory removing member; and a control unit;

wherein a cleaning sequence of the toner adhered to the memory removing member is controlled and the frequency for carrying out the cleaning according to the current flowing through the memory removing member is changed;

wherein the control unit controls to change the frequency for carrying out the cleaning sequence when the absolute value of the current detected by the current detecting circuit becomes lower than the designated value, and wherein the control unit carries out the cleaning sequence when the number of the recording medium of which the image is formed reaches a designated number, and controls the designated number to be small when the absolute value of the current detected by the current detecting circuit becomes lower than the designated value.

8. An image forming machine according to claim 7 wherein a predetermined voltage is applied to the memory removing member and the current at the time when the voltage is applied to the memory removing member is detected by the detecting circuit.

9. An image forming machine according to claim 8 wherein the memory removing member is a brush.

10. An image forming machine according to claim 7, further comprising:

a charging member for charging the photoconductive body.

11. An image forming machine according to claim 7, further comprising:

an exposing unit for forming an electrostatic latent image on the surface of the charged photoconductive body.

12. An image forming machine according to claim 7, further comprising:

a developing unit for developing the electrostatic latent image on the surface of the photoconductive body.

* * * * *